US006174042B1

(12) United States Patent
Kobayashi et al.

(10) Patent No.: US 6,174,042 B1
(45) Date of Patent: Jan. 16, 2001

(54) INK JET RECORDING APPARATUS

(75) Inventors: Atsushi Kobayashi; Seiji Mochizuki; Kazuhisa Kawakami; Shigenori Fukasawa; Masahiro Isono, all of Nagano (JP)

(73) Assignee: Seiko Epson Corporation, Tokyo (JP)

( * ) Notice: Under 35 U.S.C. 154(b), the term of this patent shall be extended for 0 days.

(21) Appl. No.: 08/967,819

(22) Filed: Nov. 12, 1997

(30) Foreign Application Priority Data

| | | |
|---|---|---|
| Nov. 11, 1996 | (JP) | 8-314209 |
| Jul. 25, 1997 | (JP) | 9-215988 |
| Jul. 25, 1997 | (JP) | 9-215989 |
| Jul. 31, 1997 | (JP) | 9-220198 |

(51) Int. Cl.[7] ..... B41J 2/165
(52) U.S. Cl. ..... 347/23; 347/7
(58) Field of Search ..... 347/23, 7, 14

(56) References Cited

U.S. PATENT DOCUMENTS

| | | | | |
|---|---|---|---|---|
| 5,663,750 | * | 9/1997 | Sakuma | 347/7 |
| 5,828,389 | * | 10/1998 | Yamaguchi et. al. | 347/23 |
| 5,844,583 | * | 12/1998 | Onishi et al. | 347/16 |
| 5,847,726 | * | 12/1998 | Hori | 347/23 |
| 5,880,751 | * | 3/1999 | Nishikori et al. | 347/14 |
| 6,000,778 | * | 12/1999 | Koitabashi et al. | 347/23 |

FOREIGN PATENT DOCUMENTS

| | | | | |
|---|---|---|---|---|
| 0 398 348 | | 11/1990 | (EP) | B41J/2/165 |
| 0 552 472 | | 7/1993 | (EP) | B41J/2/165 |
| 615 846 | * | 9/1994 | (EP) | B41J/2/175 |
| 0 615 846 | | 9/1994 | (EP) | B41J/2/175 |
| 0 707 969 | * | 4/1996 | (EP) | B41J/2/17 |
| 519467 | | 3/1993 | (JP) . | |
| 588552 | | 4/1993 | (JP) . | |
| 7205419 | | 8/1995 | (JP) . | |
| 82649 | | 1/1996 | (JP) . | |
| WO 92/18335 | * | 10/1992 | (WO) | B41J/2/175 |

OTHER PUBLICATIONS

Patent Abstracts Of Japan vol. 096, No. 002, Feb. 29, 1996, & JP 07 276667 A (Brother Ind Ltd) Oct. 29, 1996 *Abstract.

Patent Abstracts Of Japan, vol. 096, No. 003, Mar. 29, 1996, & JP 07 309018 A (Brother Ind Ltd) Nov. 28, 1995 *Abstract.

* cited by examiner

*Primary Examiner*—N. Le
*Assistant Examiner*—Shih-Wen Hsieh
(74) *Attorney, Agent, or Firm*—Sughrue, Mion, Zinn, Macpeak & Seas, PLLC

(57) ABSTRACT

An ink jet recording apparatus includes an ink consumption operating unit that adds a quantity of ink to be discharged by suction processing as a quantity of ink consumed before performing the suction processing. The ink jet recording apparatus includes also a suction control unit that performs the suction processing after such addition. A remaining ink level is calculated by estimating a quantity of ink to be used in a large volume for sucking as a quantity of ink consumed, and, even if a power supply switch is turned off before the sucking operation is terminated, the calculated remaining ink level as a quantity of ink consumed is added to a consumption storage unit 33. As a result, a possible erroneous overestimation of the remaining ink level in an ink cartridge can be avoided.

36 Claims, 9 Drawing Sheets

INK JET RECORDING APPARATUS

BACKGROUND OF THE INVENTION

1. Field of the invention

The invention relates to an ink jet recording apparatus that has a recording head that moves across the width of a recording paper and forms images by jetting ink droplets onto the recording paper so as to coincide with printing data. More specifically, the invention is directed to a technique for controlling the quantity of ink in an ink cartridge.

2. Related Art

An ink jet printer is an apparatus (i.e., an ink jet recording apparatus) that includes an ink jet recording head. The ink jet recording head is supplied with ink from a source of ink such as an ink cartridge (i.e., a means for storing ink, which may be referred to as ink storage means for convenience). The ink jet printer also includes means for moving the recording paper relative to the recording head (for convenience, this may be referred to as paper forwarding means. The ink jet printer makes a recording by jetting ink droplets from the recording head in correspondence with a print signal.

Because the ink used is a liquid, an ink jet printer must perform a variety of secondary operations and certain types of processing that are not required in printers having wire dot recording heads or thermal recording heads. In particular, some of the operations required of an ink jet recording apparatus are the charging of ink into the recording head, the forcible sucking and discharging of the ink from the recording head to prevent clogging (due to the volatilization of an ink solvent), and the control over the remaining ink level in the ink storage means.

Particular attention will now be paid to this latter operation, that is, the control over the remaining ink level in an ink storage means such as an ink cartridge.

One approach to controlling over the remaining ink level is a hardware-based detection technique. According to this first approach, liquid level detecting means (such as electrodes) are attached to the ink storage means. This approach has drawbacks. In particular, providing liquid level detection hardware requires a more complicated structure for the ink storage means. This more complicated structure increases the cost of manufacture.

Another approach to controlling the remaining ink level is a software-based approach. This second approach helps to overcome the drawbacks of the first approach. Examples of this second, software-based approach may be found in (1) Examined Japanese Patent Publication No. Hei. 5-19467, (2) Examined Japanese Patent Publication No. Hei. 8-2649, (3) Unexamined Japanese Patent Publication No. Hei. 5-88552, and (4) Unexamined Japanese Patent Publication No. Hei. 7-205419. The foregoing four examples of the second approach mention software which involves steps like:

- integrating quantities of ink consumed, using a counter, based on the sum of the product of the number of dots during printing and the quantity of ink to be consumed per ink droplet and the product of the quantity of ink to be sucked per forced sucking operation for preventing the clogging of nozzle openings and the number of sucking operations;
- displaying the remaining ink level by storing the integrated quantity of ink consumed; and
- allowing the integrated quantity of ink consumed to be reset through an external operation. That is, the approach to the control of the remaining ink level evidenced in the four examples mentioned above is to use software. As the example steps just shown reveal, the general software-based approach takes advantage of the functions of a microcomputer incorporated in the recording apparatus.

An ink jet recording apparatus that controls the remaining ink level by means of software, as in the above-identified second approach, can consecutively compute the quantity of ink consumed in relative terms correctly, although ink end detection accuracy may not be so satisfactory. Therefore, by displaying the thus-computed quantity of ink consumed, the user can be kept informed of how much ink is being consumed. Color ink jet printers now are commonly in practical use. Color ink jet printers use diversified techniques to achieve high printing quality. Some of these diversified techniques include using dark and light inks, adjusting the quantity of ink per ink droplet based on printing data, and changing print resolution in accordance with images and texts. All of these techniques tend to complicate proper control under the second approach described above.

Another complicating factor relates to the maintenance processing of the printer. Maintenance processing includes the actions taken to prevent the clogging of the ink jet recording head. During such maintenance processing, certain quantities of ink are forcibly jetted or flushed from the ink jet recording head. Of course, this ink comes from the ink storage means and must be accounted for. The quantities of ink to be forcibly jetted and flushed are meticulously specified, in a variety of ways, and the actual quantity consumed may vary in accordance with the present or recent operations of the recording head.

The diversified techniques of color ink jet printing and the maintenance processing for preventing clogs result in a very complicated situation for which ink consumption must be predicted under the second (software-based) approach. The above-identified four examples of the second approach for controlling the remaining ink level cannot take care of such a complicated ink consumption situation without producing grave errors. The above-identified software-based approaches do not meet the requirement for providing an accurate determination of the remaining ink level. Because the remaining ink level cannot correctly be computed under the above-identified software-based approaches, there is an increased risk of damage to ink jet recording heads operating under such approaches. In particular, the printer might attempt to jet ink droplets from the ink jet recording head even after all of the ink is used up. Such an operation might easily cause fatal damage to an ink jet recording head due to the ink sucking operations performed for maintenance.

There is yet another drawback to the above-identified four examples of the second approach to control of the remaining ink level. This drawback relates to the already mentioned counter. In particular, there may be a requirement that the user reset the remaining ink level control counter by operating a reset button whenever replacing an ink cartridge. If the user replaces the cartridge without resetting the counter, an inconvenient situation arises. That is, because the user has forgotten to operate the reset button, printing operations cannot be performed even though the ink storage means (i.e., the ink cartridge) has available a plentiful supply of ink.

SUMMARY OF THE INVENTION

The invention seeks to overcome the shortcomings and drawbacks mentioned above.

The invention is applied to an ink jet recording apparatus that includes: an ink jet recording head for jetting an ink droplet so as to correspond to printing data; an ink cartridge for supplying ink to the recording head; a capping means not only sealing the recording head but also being subjected to a negative pressure by a suction pump; a suction control means for controlling suction processing for discharging the ink by sucking the recording head with the suction pump; and a remaining ink level judging means for controlling a quantity of ink in the ink cartridge by integrating quantities of ink discharged from the recording head. In such ink jet recording apparatus, the remaining ink level judging means adds a quantity of ink to be discharged by the suction processing as a quantity of ink consumed, the addition being made before performing the suction processing, and the suction processing is thereafter performed.

The remaining ink level is calculated by estimating the quantity of ink to be used in a large volume for sucking as the quantity of ink consumed. Therefore, even if a power supply switch is turned off before the sucking operation is brought to an end, a possible erroneous overestimation of the remaining ink level in an ink cartridge can be precluded. Hence, the recording head can be prevented from being damaged by the sucking of ink and the printing performed with the remaining ink level being low.

Therefore, a first object of the invention is to provide an ink jet recording apparatus that can prevent the recording head from being damaged accidentally even if the ink has been consumed in large quantities due to sucking operations and the like by computing the quantity of ink in the ink cartridge while minimizing erroneous integration of such quantity to be caused by the turning off of the power supply or the like.

A second object of the invention is to provide an ink jet recording apparatus that can prevent the recording head from being broken by adjusting the quantity of ink to be sucked for the maintenance of the recording head based on the correctly computed quantity of ink consumed.

A third object of the invention is to provide an ink jet recording apparatus that can print data with the highest possible quality even if the ink remaining in the ink cartridge is at a near end level.

A fourth object of the invention is to provide an ink jet recording apparatus that can not only prevent the running out of ink by precluding underestimation of the quantity of ink to be sucked in association with the loading of an ink cartridge but also give a message to the effect that ink charging processing after loading the ink cartridge has been terminated.

A fifth object of the invention is to provide an ink jet recording apparatus that can judge the remaining ink level for a new ink cartridge by automatically resetting the quantity of ink consumed in the case where an old ink cartridge has been replaced with the remaining ink level therein being extremely low.

DETAILED DESCRIPTION OF THE PREFERRED EMBODIMENTS

Figure 1:
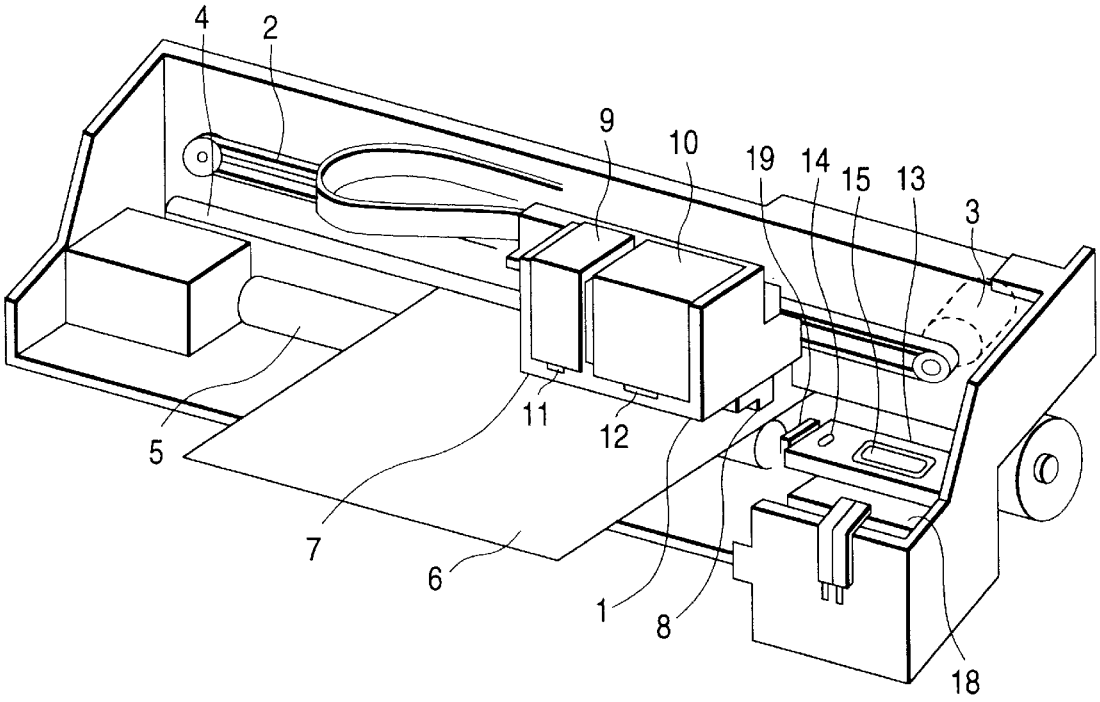
FIG. 1 is a perspective view showing an ink jet recording apparatus, which is an embodiment of the invention.

FIG. 1 shows an embodiment of the invention. A carriage 1 is connected to a motor 3 through a timing belt 2 and moves in parallel to a platen 5 while guided by a guide member 4. Recording heads 7, 8 are mounted on the carriage 1 surface that confronts a recording paper 6. The recording head 7 jets black ink onto a printing region (left side as viewed in FIG. 1) and the color printing recording head 8 is releasably mounted in a nonprinting region. The respective recording heads 7, 8 jet ink droplets onto the recording paper 6 while having inks supplied by a black ink cartridge 9 and a color ink cartridge 10, respectively. Further, switches 11, 12 are disposed on the carriage 1. These switches 11, 12 are turned on and off upon loading and unloading the ink cartridges 9, 10.

A capping device 13 is formed by mounting a cap member 14 for sealing the black ink recording head 7 and a cap member 15 for sealing the color ink recording head 8 on the same slider. The cap members 14, 15 are large enough to seal the nozzle opening surfaces of the recording heads 7, 8 in single spaces, respectively, and are connected through tubes to a pump unit 18. The capping device 13 thus is an example of means for sealing the ink jet recording head.

The pump unit 18 includes two pumps 16, 17 that can be driven independently. As a result of this construction, the capping device 13 seals the nozzle openings during a nonprinting period, and forcibly discharges ink from the recording heads 7, 8 while being subjected to a negative pressure by the pump unit 18 when the ink jetting capability recovering operation is being performed. Further, a cleaner unit 19 is disposed in the vicinity of the capping device 13. Thus, the capping device 13 is an example of a structure that also doubles as a means for allowing the ink jet recording head to be subjected to a negative pressure by the suction pump. Although the capping device performs the above-identified functions for sealing and for suction, it may, for convenience, be referred to simply as a capping means.

Figure 2:
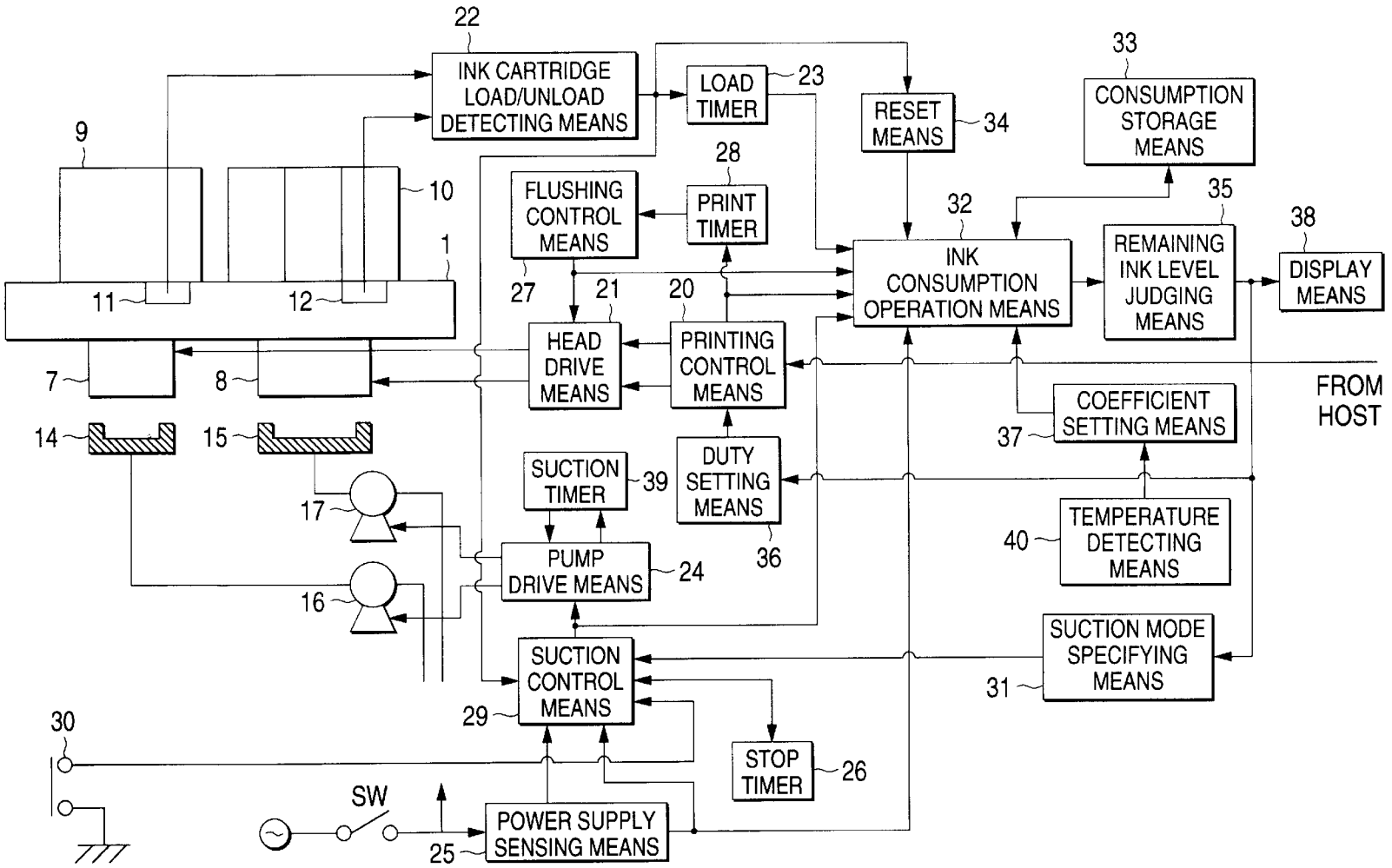
FIG. 2 is a block diagram showing an embodiment of the invention.

FIG. 2 shows a controller for controlling the operation of the recording apparatus, the controller being an embodiment of the invention. A printing control means 20 generates bit map data based on printing data sent from a host, and jets ink droplets out of the recording heads 7, 8 by causing a head drive means 21 to produce drive signals based on the generated bit map data.

An ink cartridge load/unload detecting means 22 detects the loading and unloading of the ink cartridges 9, 10 from signal changeovers of the respective switches 11, 12 disposed on the carriage 1. A load timer 23 resets itself upon loading the ink cartridges 9, 10 based on a signal from the ink cartridge load/unload detecting means 22 and thereafter starts measuring time, and then stops measuring time upon unloading the ink cartridges 9, 10.

A pump driving means 24 performs a sucking operation based on the sucking strength, the sucking time, and the sucking interval defined by a suction control means 29 to be described later. A power supply sensing means 25 detects the supply of power to the apparatus, and outputs a signal upon the turning on and off the power supply. A stop timer 26 starts measuring time upon turning off the power supply and stops measuring time upon turning on the power supply. That is, the stop timer 26 detects a time period during which the recording heads 7, 8 have continuously been sealed by the capping device 13.

A flushing control means 27 jets a predetermined number of ink droplets out of all the nozzle openings of the respective recording heads 7, 8 after the carriage 1 has been evacuated to a flushing position, usually at the capping position, by the printing control means 20 upon detection by a print timer 28 of a predetermined time period for which a printing operation has lasted. The flushing operation is performed to prevent and eliminate nozzle clogging.

The suction control means 29 operates the respective pumps 17, 18 in a predetermined mode by delivering a signal to the pump drive means 24 with the recording heads 7, 8 sealed by the capping device 13 based on a signal from a suction mode specifying means 31 to be described later. The suction control means 29 is designed to intervene when a signal is received from an externally operable cleaning switch 30, when new ink cartridges 9, 10 are loaded, or when the stop timer 26 has measured a predetermined time upon turning on the power supply. The suction mode specifying means 31 specifies a mode selected from one of three possible modes: large-scale suction mode, a small-scale suction mode, and a suction save mode in accordance with the remaining ink level of the ink cartridges 9, 10.

An ink consumption operating means 32 reads the value corresponding to the quantity of ink consumed, which value is stored in a consumption storage means 33 to be described later. The ink consumption operating means 32 performs this reading operation when power supply sensing means 25 senses the turning on of the power supply.

The ink consumption operating means counts the number of ink droplets whenever a printing operation or a flushing operation is performed. Based on the counted number of ink droplets, the ink consumption operating means calculates the quantity of ink consumed. This calculation of the quantity of ink consumed may be performed by multiplying the counted number of ink droplets by the quantity of ink per ink droplet. The quantity of ink used per ink droplet may be based on data stored in a coefficient setting means 37 to be described later.

When the suction control means 29 gives a suction command to the pump drive means 24, the ink consumption operating means may perform the calculation of the quantity of ink consumed by adding the quantity of ink to be sucked in advance.

The coefficient setting means 37 stores data relating to the quantity of ink per ink droplet for color and black inks as shown in Tables 1 and 2. That is, the coefficient setting means 37 stores data on the quantity by weight of ink per ink droplet for color and black inks so as to correspond to print modes such as a high-definition print mode, a normal print mode, and a draft print mode as shown in Table 1. Further, the coefficient setting means 37 stores data on the quantity by weight of ink per ink droplet for color and black inks so as to correspond not only to flushing operations (such as flushing before printing, periodic flushing during printing, and flushing after printing) but also to print modes for periodic flushing.

It is preferred that the quantity of ink per ink droplet be calculated so as to be temperature-compensated based on temperature data sent from a temperature detecting means 40. To explain, it is assumed that at room temperature the ink droplet has a reference value of 1. At a temperature of 30° C., the quantity of ink per ink droplet is actually about 1.03 times that of the reference value. At a temperature of 40° C., the quantity of ink per ink droplet is actually about 1.05 times that of the reference value. As operating temperatures rise above room temperature, the quantity of the ink discharged has a larger volume due to the reduced viscosity caused by increased temperature. Thereby, the amount of ink expended per ink droplet can reliably be added as a quantity of ink consumed. Therefore, this temperature compensation contributes greatly to determining correctly the ink consumption and thus is particularly contributory to preventing the running out of the ink during printing.

When the power supply sensing means 25 detects the turning off of the power supply, the calculated quantity of ink consumed is stored in the consumption storage means 33, and when a signal from a reset means 34 is applied upon detection of replacement of the ink cartridges 9, 10 by the ink cartridge load/unload detecting means 22, the calculated values are reset.

A remaining ink level judging means 35 calculates a difference between the quantity of ink contained in the respective ink cartridges 9, 10 and the quantity of ink consumed as calculated by the ink consumption operating means 32, and feeds a signal to the suction mode specifying means 31, and to a duty setting means 36 and a display means 38, which will be described later, every time the difference falls below one of a plurality of reference values that are defined by graduation.

That is, as shown in Table 3, the following remaining ink levels are available: two ink end levels, a near end level, a large-scale suction prohibit level, and a suction prohibit level. The ink end levels include a level in which the ink within the ink cartridges has run out and a level in which ink at least some remains in the ink cartridges after an ink sucking operation has been performed. The near end level is a level in which some 2 to 20% of the total ink remains. The large-scale suction prohibit level is a level in which some 2 to 25% of the total ink remains. The suction prohibit level is a level in which some 2 to 30% of the total ink remains.

Out of the aforementioned parts and components, it is preferred that the ink consumption operating means 32, of which a particularly high calculation capability is required, be incorporated as part of the function of the CPU belonging to the host apparatus through the printer driver software installed into the host apparatus.

The operation of the thus constructed apparatus will now be described based on the flowcharts shown in FIGS. 3 through 9.

Overall Operation

Figure 3:
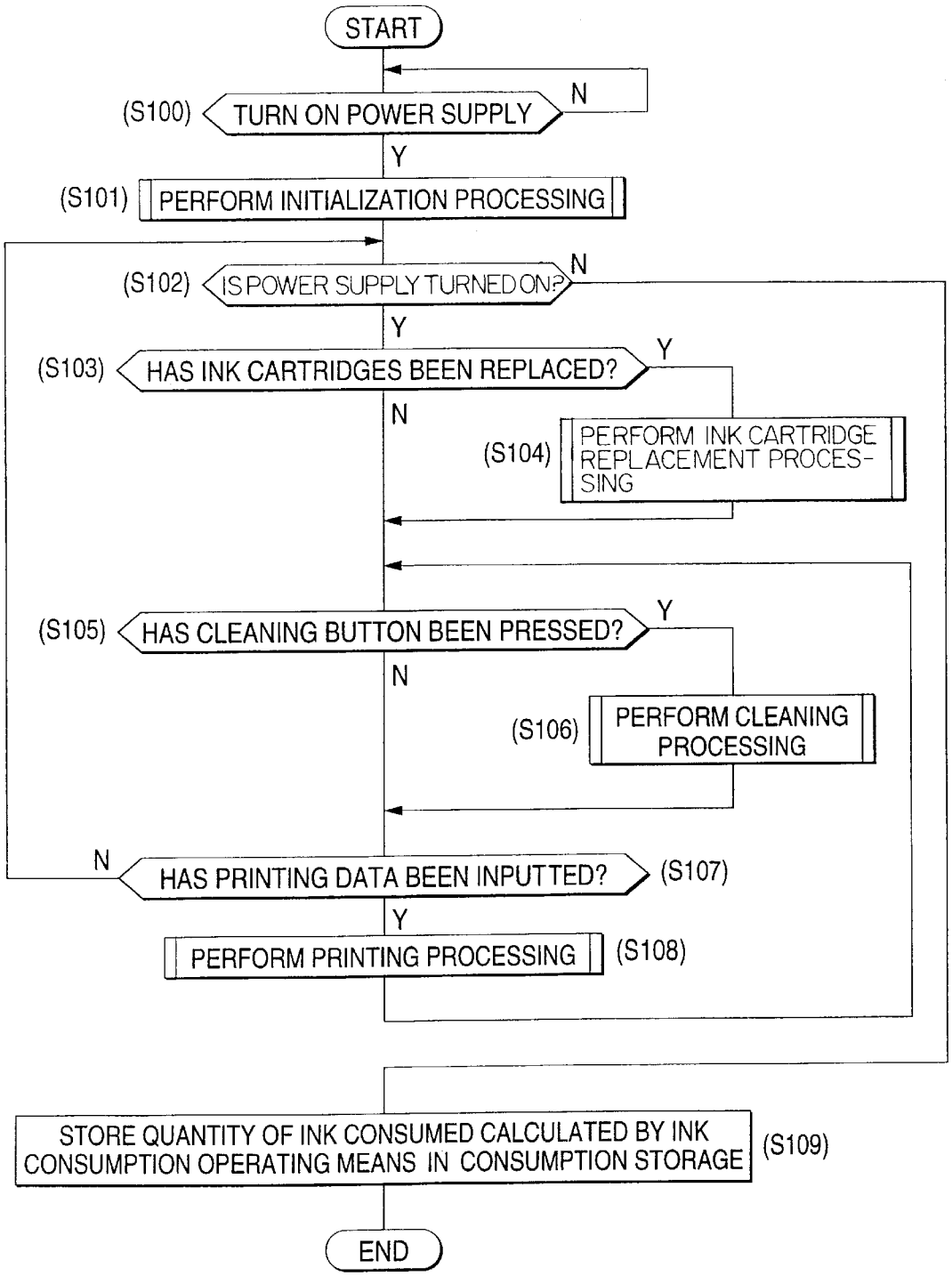
FIG. 3 is a flowchart showing the overall operation of the apparatus.

See FIG. 3. Upon turning a power supply switch SW on (S100), initialization processing (FIG. 4), which will be described later, is performed (S101). Then it is judged whether or not the power supply remains on (S102). If the power supply switch is off when this step is performed, the overall operation is brought to an end after the power supply turn-off processing has been performed (S109). The power supply turn-off processing includes storing the quantity of ink calculated by the consumption operating means 32 into the consumption storage means 33.

On the other hand, if the power supply is on when step S102 is performed, a determination is made as to whether or not the ink cartridges 9, 10 have been replaced (S103). This determination is based on a signal from the ink cartridge load/unload detecting means 22. If the ink cartridges have been replaced, ink cartridge replacement processing (FIG. 6), which will be described later, is performed (S104).

Processing then continues with a determination as to whether the cleaning button or switch 30 has been pressed. If the ink cartridge replacement processing has not been performed or if the cleaning switch 30 has been pressed after replacement of the ink cartridges 9, 10 has been complete (S105), then cleaning processing (FIG. 7), which will be described later, is performed (S106).

Processing thereafter continues with a determination as to whether there is any printing data (S107). If there presently is no printing data, the processing steps (S102) through (S107) are repeated. Thus, the printer waits for either the presence of printing data (detected at S107) or the shutting off of the power supply (detected at S102).

Upon reception of printing data, printing processing (FIG. 8), which will be described later, is initiated (S108).

When the power supply switch SW is turned off, the operation is brought to an end after the quantity of ink consumed calculated by the ink consumption operating means 32 has been stored in the consumption storage means 33 (S109) and the stop timer 26 has been operated, if necessary.

Initialization Processing

Figure 4:
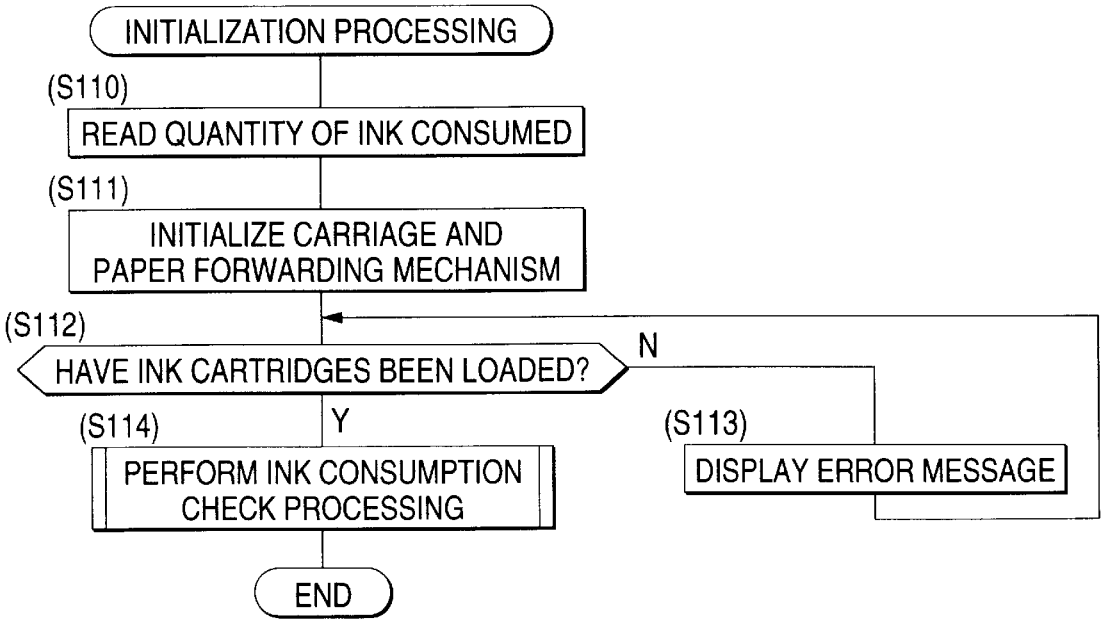
FIG. 4 is a flowchart showing an operation for initialization processing out of the operation of the apparatus.

See FIG. 4. FIG. 4 shows the details of initialization processing according to an embodiment of the invention (refer to S101 of FIG. 3). When the power supply sensing means 25 detects the turning on of the power supply, the consumption operating means 32 reads from the consumption storage means 33 the data relating to the quantity of ink already consumed (S110). The consumption storage means then performs initialization processing such as positioning carriage 1 and forwarding paper. These activities make the apparatus ready for printing (S111).

When the apparatus is ready for printing, processing continues with S112 where a determination is made as to whether or not the ink cartridges 9, 10 are loaded. This determination is based on a signal from the ink cartridge load/unload detecting means 22. If ink cartridges are not loaded, the display means 38 displays an error message (S113), and the apparatus stands by until the ink cartridges 9, 10 are loaded. Upon confirmation that the ink cartridges 9, 10 having been loaded correctly, ink consumption check processing, which will be described later, is performed (S114).

Ink Cartridge Initial Charging

Figure 5:
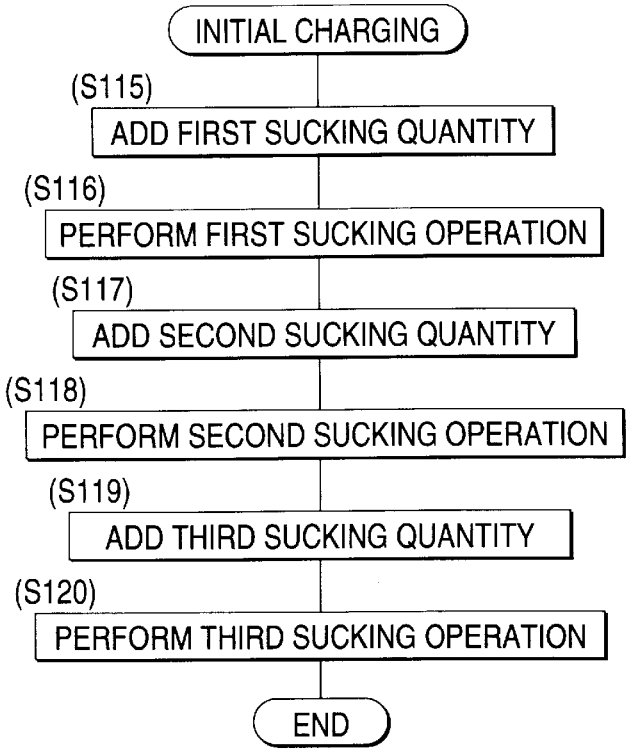
FIG. 5 is a flowchart showing an operation for initial charging processing.

See FIG. 5. The ink jet recording apparatus is designed to jet ink droplets out of nozzle openings by causing pressure producing chambers to apply pressure to the ink. Therefore, in view of such design, the ink jet recording apparatus is required to maintain the same condition both during shipment and during operation. That is, for meeting such a requirement, measures to prevent the drying of the recording heads or entrance of dust into the recording heads are taken by charging a dummy solution into the recording heads. Therefore, prior to starting up the operation of the recording apparatus, the dummy solution charged into the recording heads 7, 8 must be completely discharged; i.e., a so-called initial loading operation must be performed.

In order reliably to account for the discharge of the dummy solution, a first quantity of ink to be sucked, which is the quantity of ink to be discharged by a first sucking operation, is added to the consumption operating means 32 in advance (S115). Next, a sucking operation is performed at the sucking speed specified for the first sucking operation (S116). Then, a second quantity of ink to be sucked, which is the quantity of ink to be discharged by a second sucking operation, is added to the consumption operating means 32 in advance (S117). Then, a sucking operation is performed at the sucking speed specified for the second sucking operation (S118). A third quantity of ink to be sucked, which is the quantity of ink to be discharged by a third sucking operation, is added to the consumption operating means 32 in advance (S119). Then, a sucking operation is performed at the sucking speed specified for the third sucking operation (S120).

Thus, the quantities of ink to be used for initial charging are added, in advance, on a step-by-step basis before sucking operations are performed with respect to the ink cartridges 9, 10 in large quantities. Therefore, even if the power supply is turned off during a sucking operation, the quantity of ink remaining in the ink cartridges 9, 10 can conservatively be estimated. As a result, the running out of ink during printing and the draining of ink out of the recording heads 7, 8 can be avoided.

Ink Cartridge Replacement Processing

Figure 6:
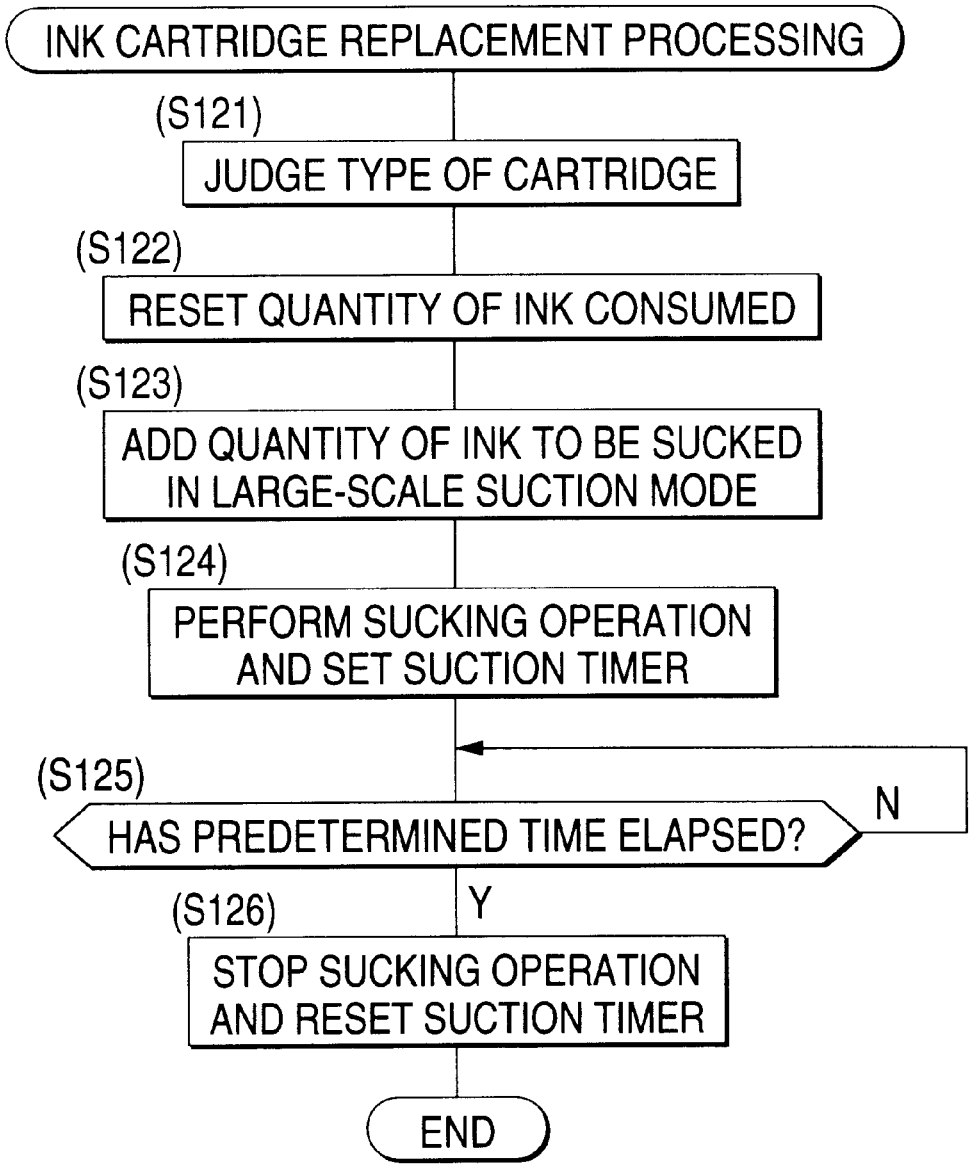
FIG. 6 is a flowchart showing an operation for ink cartridge replacement processing.

See FIG. 6. When the near end level or the ink end level is detected by the remaining ink level judging means 35 despite the fact that the ink cartridge load/unload detecting means 22 has detected the loading of new ink cartridges, the reset means 34 determines whether it is the black ink cartridge 9 or the color ink cartridge 10 that signals the detected ink level (S121). If it is the black ink cartridge 9 that signals the detected ink level, the quantity of ink consumed in the black ink cartridge is reset (S122), whereas if it is the color ink cartridge 10 that signals the detected ink level, the quantity of ink consumed in the color ink cartridge is similarly reset (S122).

As a result of this operation, the quantity of ink consumed can be automatically reset only by performing the ink cartridge replacement processing. That is, the ink consumption resetting operation to be performed by the user after the ink cartridges have been replaced can be dispensed with, and the resetting errors so often associated with the user can be precluded.

On the other hand, if the remaining ink level judging means 35 indicates other levels that are larger than the near end level, the ink consumption resetting operation is not performed by the ink consumption operating means 32 under the judgment that the user has erroneously unloaded and then loaded the same ink cartridges. In this case, even if it has been judged erroneously that the old ink cartridges have been unloaded and then loaded despite the fact that such old ink cartridges have actually been replaced with new ink cartridges, and even if the ink is thereafter sucked in large quantities for the cleaning processing and the like, the draining of ink from the recording heads 7, 8 can reliably be prevented.

The remaining ink level judging means 35 judges that the ink remains in large quantities from the fact that the quantity of ink consumed has been reset. The suction mode specifying means 31 outputs to the suction control means 29 a signal indicating a large quantity of ink may be sucked in association with replacement of the ink cartridges. As a result, the suction control means 29 performs suction processing in the large-scale suction mode, which will be described later, and operates the suction timer 39 (S124). When the suction timer 39 has measured a predetermined time T1 that is equivalent to the large quantity of ink to be sucked (S125), the suction processing is stopped and the suction timer 39 is then reset (S126).

Not only is the remaining ink level (at the time the ink has been charged) indicated in relative terms (i.e., in percentage), but the remaining ink level also is controlled based on this percentage until a next replacement of the ink cartridges. By indicating the quantity of ink that is given by subtracting the quantity of ink to be sucked in association with replacement of the ink cartridges as being 100% in this way, the user can be informed of the remaining ink level as correctly as possible.

Further, for the operation of charging the ink into the noncharged recording heads 7, 8 prior to starting up the recording apparatus, i.e., for the so-called initial charging operation, the quantity of ink given by subtracting the quantity of ink to be sucked that is equivalent to the quantity of ink to be initially charged is displayed as being 100%. As a result of this indication, even if there is a difference in the quantity of ink to be consumed for an ink charging operation between ink cartridge replacement after starting up the recording apparatus and first ink cartridge loading at the time of starting up the recording apparatus, the actual remaining ink levels after performing the ink charging operations can be displayed. Thus, the user can be informed of the remaining ink levels more simply, and the indication that the remaining ink level is 100% gives the user a sign that the ink charging operation has been terminated. Hence, the user can recognize the end of the ink charging operation without any special display.

Cleaning Processing

Figure 7:
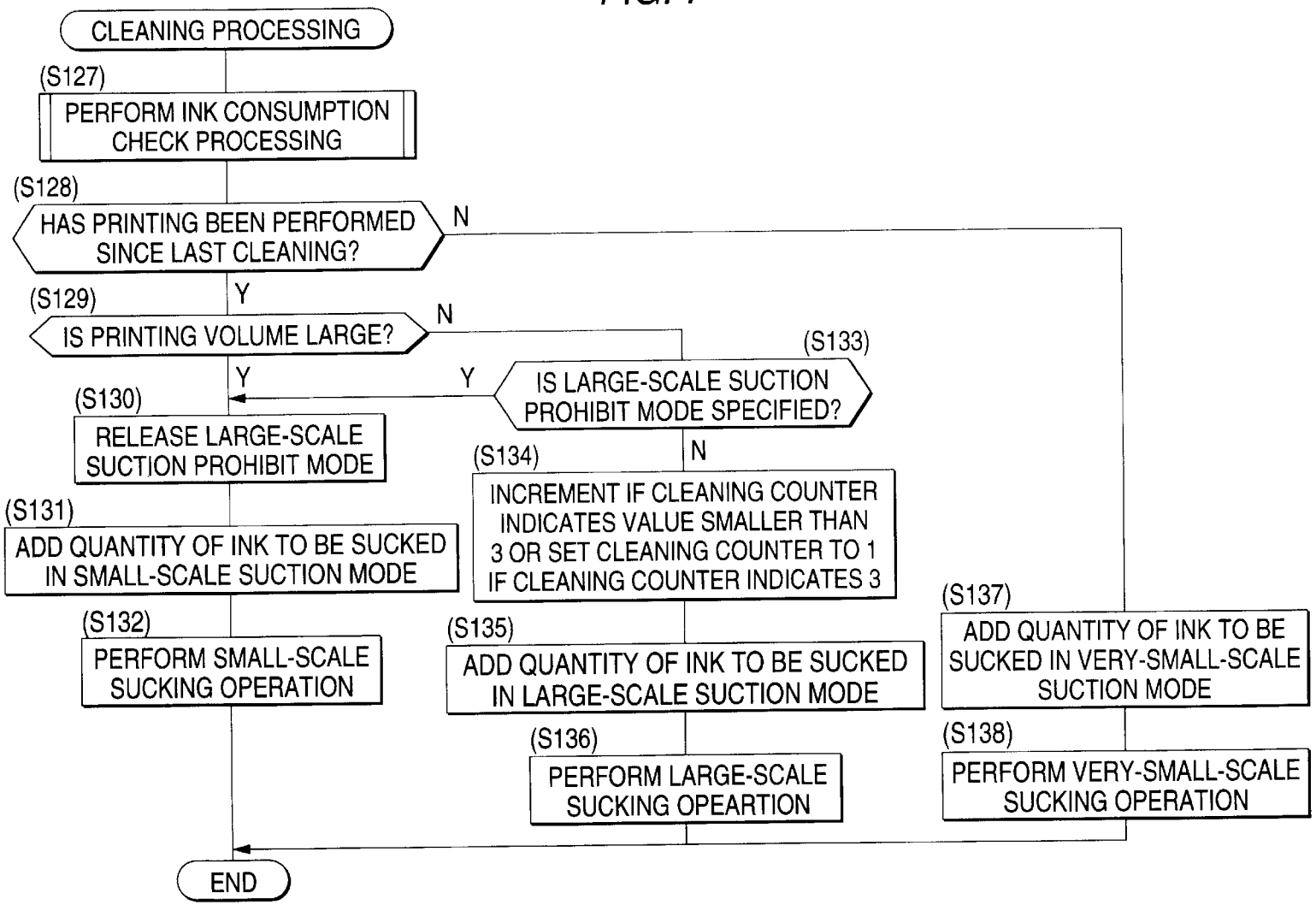
FIG. 7 is a flowchart showing an operation for cleaning processing.

See FIG. 7. When a cleaning processing command is given by pressing the cleaning switch 30, the remaining ink level is confirmed through ink consumption check processing (FIG. 9) to be described later (S127), and after the confirmation, it is judged whether or not a printing operation has been performed since the last cleaning processing (S128). If no printing operation has been performed since the last cleaning processing, the quantity of ink to be sucked in a very small-scale suction mode is added to the consumption operating means 32 in advance (S137), and upon completion of the addition, a sucking operation is performed in the very small-scale suction mode (S138).

On the other hand, if a printing operation has been performed since the last cleaning processing, the volume of data printed by such a printing operation is judged (S129). If the volume of data printed is large, then, the large-scale suction prohibit mode (S130) is released. Then, the quantity of ink to be sucked in the small-scale suction mode is added to the consumption operating means 32 (S131). Next, a small-scale sucking operation is performed (S132).

If the volume of data printed since the last cleaning processing is found to be small (S129), it is judged whether or not the large-scale suction prohibit mode is specified (S133). If so, the large-scale suction prohibit mode is released (S130), and then the small-scale sucking operation is performed (S131, S132).

On the other hand, if the large-scale suction prohibit mode is not specified and if the ink cartridges 9, 10 have plenty of ink, then the number of operations of the cleaning switch 30 in the last cleaning processing is sensed by a cleaning counter or the like. Then, if the cleaning counter indicates a predetermined number, e.g., 3, the cleaning counter is reset to 1. If the cleaning counter indicates a number lower than 3, then, after incrementing the number (S134), the quantity of ink to be consumed by large-scale suction is added to the consumption operating means 32 in advance (S135), and a sucking operation is performed in the large-scale suction mode (S136).

Thus, before suction processing is performed in the very small-scale suction mode, the small-scale suction mode, or in the large-scale suction mode, the quantity of ink to be sucked is added to the consumption operating means 32 in advance. That is, such addition processing precedes the suction processing. Therefore, unlike the case where the quantity of ink to be sucked is added after a sucking operation, even if the power supply or the like is interrupted during the suction processing, the remaining ink level of the ink cartridges 9, 10 can be set to a value on the safety side; i.e., the remaining ink level can conservatively be estimated. Hence, this processing is advantageous in preventing the draining of ink from and the introduction of bubbles into the recording heads 7, 8 due to the ink having been consumed by the suction processing.

Printing Processing

Figure 8:
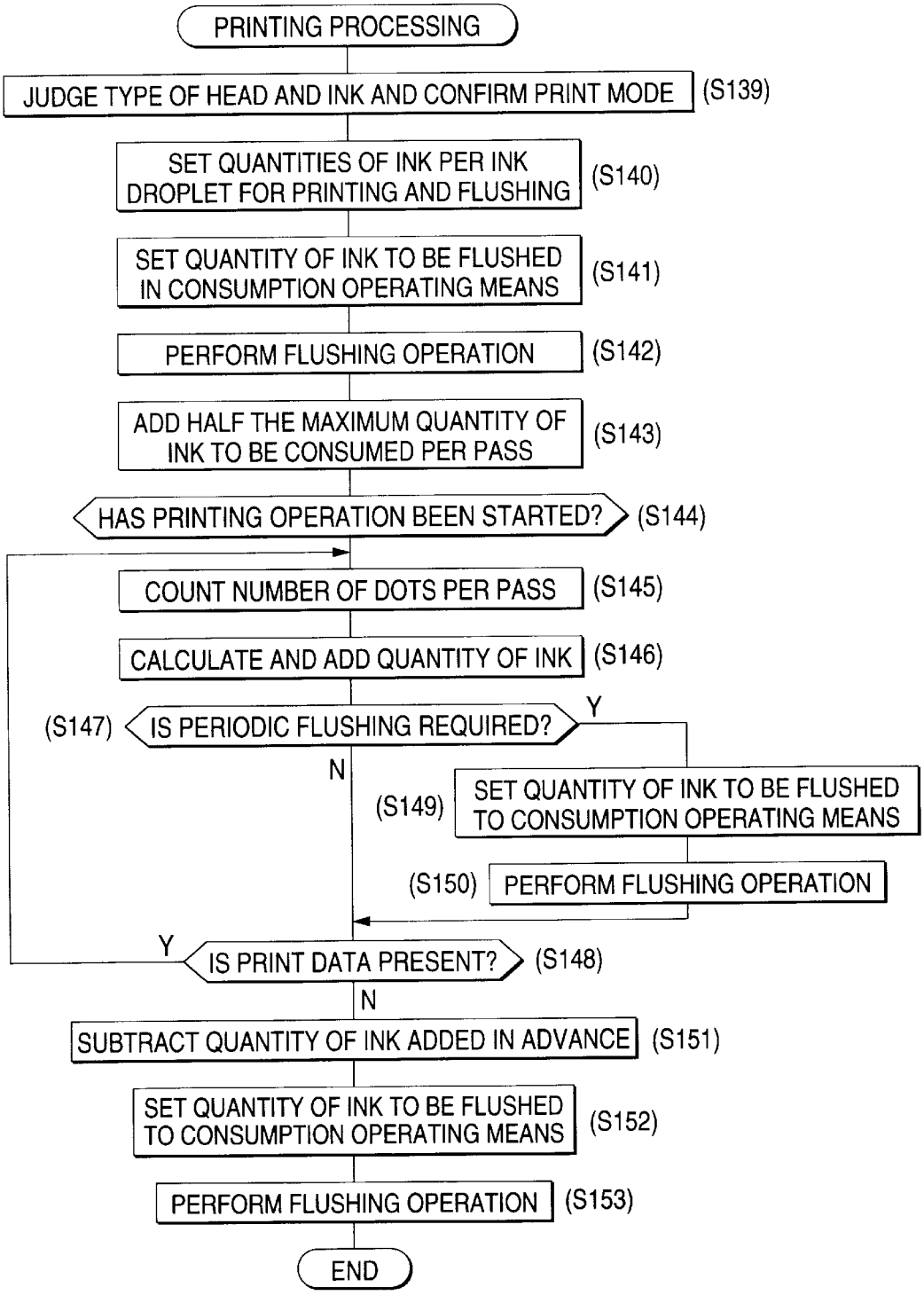
FIG. 8 is a flowchart showing an operation for printing processing.

See FIG. 8. Not only are the type of recording head 7 or 8 and the type of ink to be used for printing judged, but also the print mode is confirmed (S139). Also, the quantities of ink to be jetted per droplet both during printing with the specified recording head 7 or 8 and during flushing are set based on the data stored in the coefficient setting means 37 (S140).

The quantity of ink to be consumed by the flushing processing before printing which is to be performed prior to a printing operation is added to the ink consumption operating means 32 in advance (S141), and the flushing processing before printing is thereafter performed (S142).

When the apparatus is ready to print after the preparations for printing have been finished, the average quantity of ink to be consumed per pass of printing, e.g., the quantity of ink equivalent to half the maximum printing volume is added in advance (S143). When the printing operation is started (S144), the total number of dots per pass is counted (S145), and the quantity of ink actually consumed by a single pass of printing is calculated by multiplying the counted total number of dots by the quantity of ink per droplet, and the calculated value is then added (S146).

If the remaining ink level is judged to be at the near end level through the ink consumption check processing during printing (S158 (FIG. 9)), printing speed is reduced, e.g., by switching to a mode in which a single line of data is printed with a plurality of passes. By reducing the printing speed, in a particular case where the ink cartridges 9, 10 are of such a type that an ink absorbing body is impregnated with ink, the ink absorbing body is prevented from being evacuated to a negative pressure due to the ink therein having been consumed. As a result, the ink present in the regions of the ink cartridges 9, 10 that are remote from the ink discharge ports connected to the recording heads 7, 8 can be allowed to flow into the recording heads 7, 8 reliably, whereby the ink that is running low can more effectively be used up.

Further, if print duty is restricted by the remaining ink level having been judged to be at the suction save level (S162, S163 (FIG. 9)), the ink remaining in small quantities in the cartridges 9, 10 can reliably be supplied to the recording heads 7, 8 by reducing the printing speed or by switching to the mode in which a single line of data is printed with a plurality of passes when the data having an extremely heavy print duty such as graphic printing data are to be taken care of.

When the printing operation has lasted for a predetermined time so that the print timer 28 indicates that a periodic flushing operation is required (S (S147), the printing operation is suspended and the carriage 1 is moved to the flushing position. Then, the quantity of ink to be jetted by periodic flushing is added to the ink consumption operating means 32 in advance (S149), and the flushing processing is performed upon completion of the addition (S150).

If printing data is present after the flushing processing has been completed (S148), the aforementioned steps (S145) through (S150) are repeated to perform the printing operation.

When all the printing data is printed (S148), the quantity of ink added in advance in step (S143) is subtracted (S151), and the quantity of ink to be jetted by flushing is added to the ink consumption operating means 32 in advance (S152), and flushing processing (as printing operation termination processing) is performed (S153). Then, the apparatus waits for a next input of printing data.

Thus, a printing operation is performed after adding the average quantity of ink to be consumed by a single pass of printing prior to initiating the printing operation, and then the quantity of ink added in advance as an estimate is subtracted upon end of the single pass of printing. Therefore, by doing so, the quantity of ink actually consumed that cannot be added unless the single pass of printing is terminated can be added in the form of an equivalent quantity even if such addition cannot be made due to the power supply having been turned off. As a result, the remaining ink level in the ink cartridges can be estimated to a value as close to the actual value as possible, so that a possible running out of the ink during printing can be precluded.

Ink Consumption Check Processing

Figure 9:
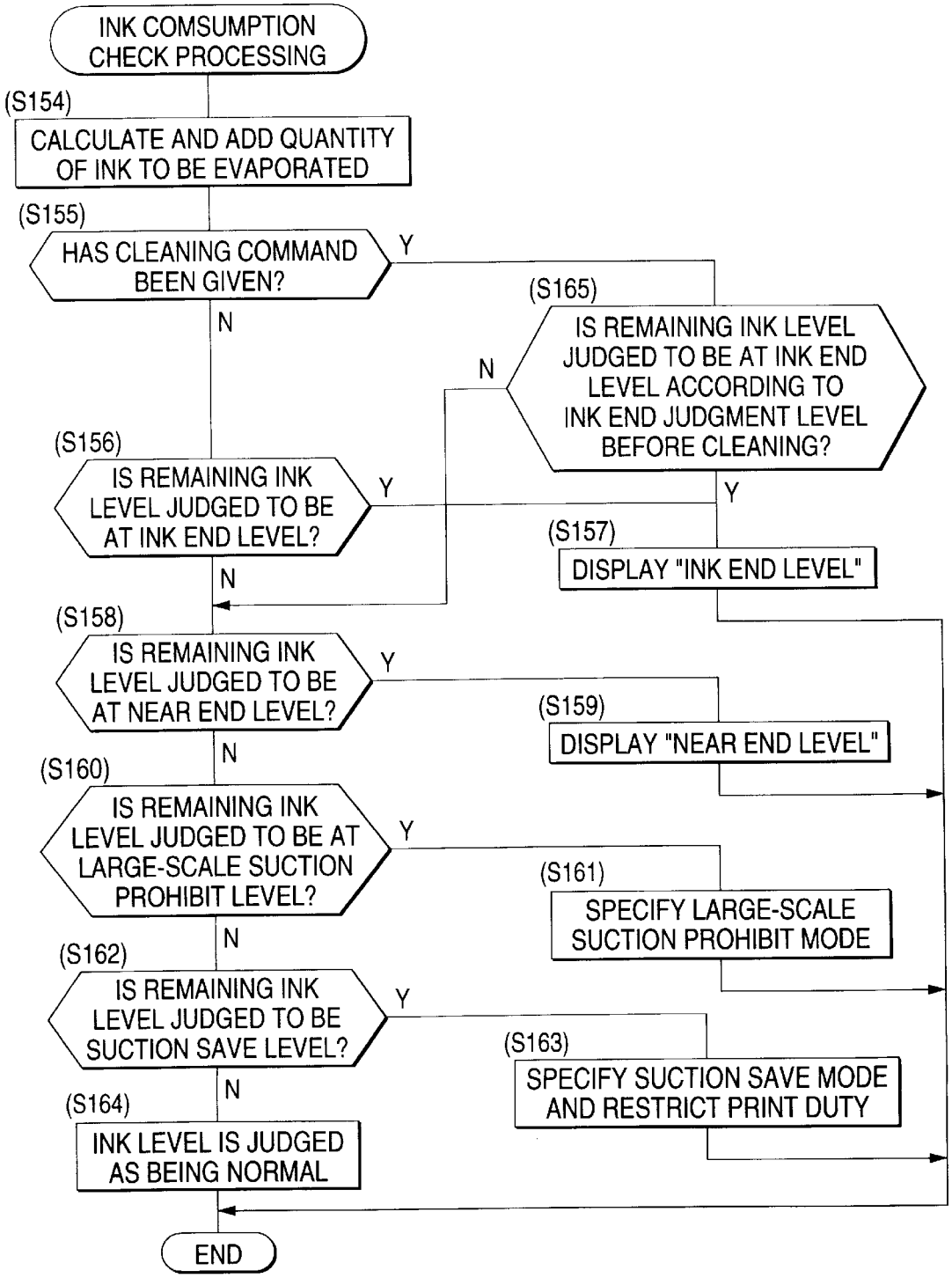
FIG. 9 is a flowchart showing an operation for ink consumption check processing out of the operation of the apparatus.

See FIG. 9. The remaining ink level of the loaded ink cartridges 9, 10 is calculated by taking into account the product of the elapsed time from the timing at which the cartridges 9, 10 for which the load timer 23 is operating have been loaded and the evaporation rate per unit time of an ink solvent from the cartridges 9, 10, the ink tubes, and the like (S154).

If a cleaning processing command has not been given before step S155, the remaining ink level is compared with ink end judgment reference levels (S156). If the remaining ink level is judged to be at the ink end level, a message to that effect is displayed on the display means 38 (S157), and there is provided a prompt to replace the ink cartridges 9, 10. If the remaining ink level is judged to be between the ink end level and the near end level (S158), then a message "near end level" is displayed on the display means 38 (S159). Further, if the remaining ink level is judged to be over the near end level and at the large-scale suction prohibit level (S160), then the large-scale suction prohibit mode is specified (S161) so as to prevent the ink from inadvertently being consumed in large quantities by cleaning.

Still further, if it is judged that the remaining ink level in the cartridges 9, 10 is somewhat low so that smooth ink supply at a normal ink sucking speed within the ink absorbing body might be interrupted although the ink can be sucked for cleaning (S162), the quantity of ink to be sucked is restricted, and the so-called duty also is restricted (S163), the duty being the number of dots to be printed per unit time during printing. In cases other than the above, it is judged that the ink cartridges 9, 10 have ink necessary and sufficient for normal operation (S164).

If the cleaning switch 30 has already been pressed prior to the ink consumption check processing (S155), it is judged before cleaning whether the remaining ink level is at the ink end level by comparing the remaining ink level with the ink end judgment level so that the apparatus gets ready for consuming ink for cleaning (S165). If it is judged that the remaining ink level is below the ink end level according to such judgment level, then the remaining ink level is judged to be at the ink end level even if a printing operation can be performed at such remaining ink level, and a message "ink end level" is displayed on the display means 38 (S157), and replacement of the ink cartridges 9, 10 is prompted before cleaning. As a result, substantially all the ink in the ink cartridges 9, 10 can be consumed, and hence a possible running out of ink from the recording heads 7, 8 can be precluded. If the remaining ink level is judged to be more than the ink end level, the aforementioned steps (S158) through (164) are performed.

Figure 10:
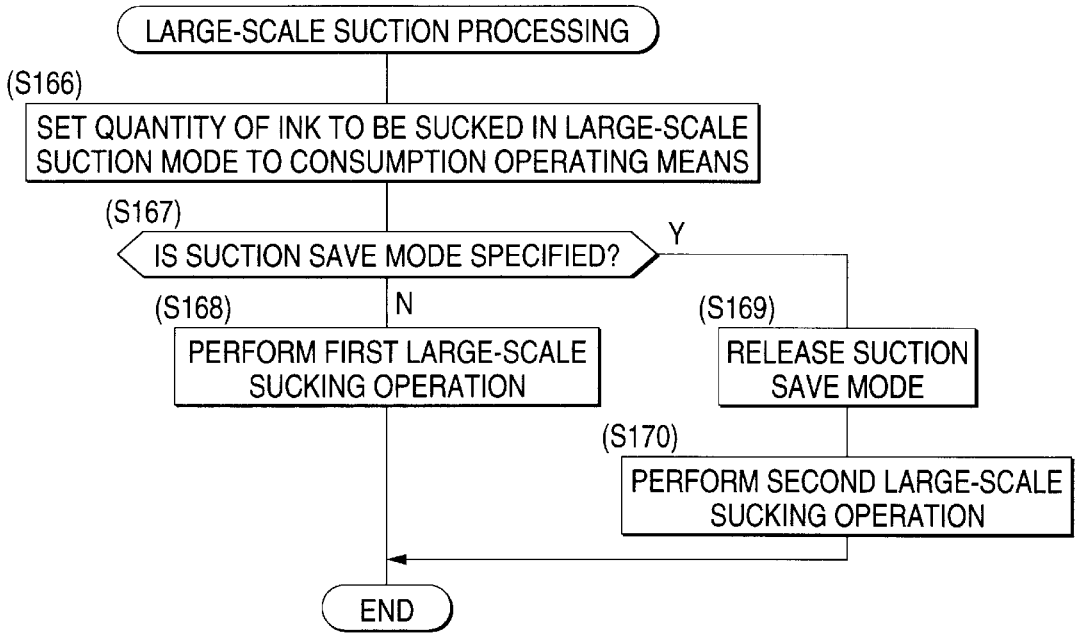
FIG. 10 is a flowchart showing large-scale suction processing, which is another embodiment of the invention.
Figure 11:
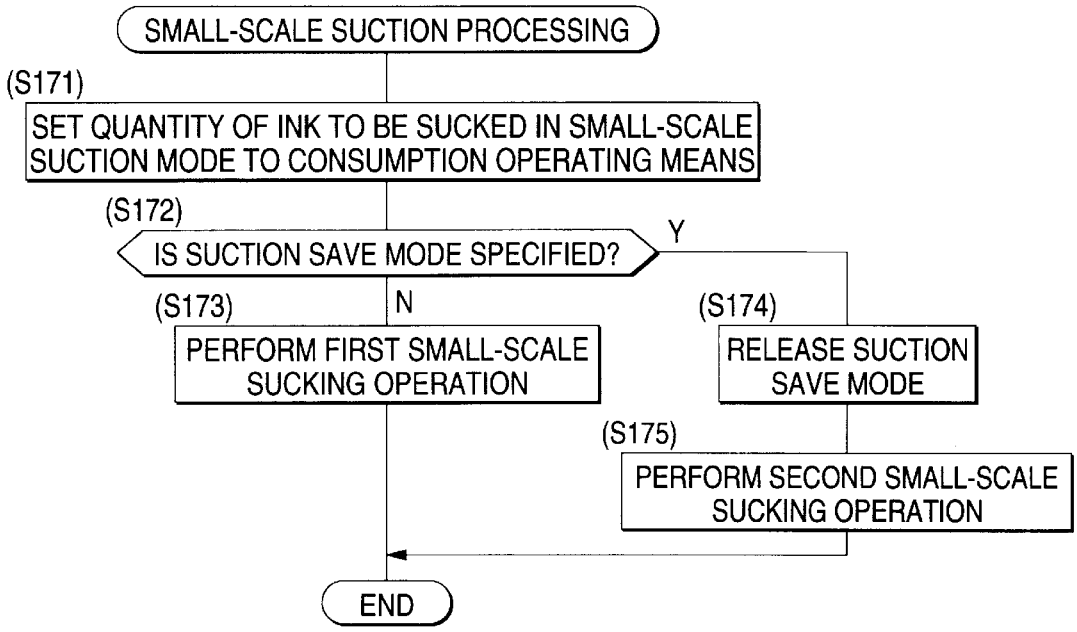
FIG. 11 is a flowchart showing small-scale suction processing, which is another embodiment of the invention.

While the large-scale suction processing and the small-scale suction processing are performed by a single suction mode in the aforementioned embodiment, the suction mode may be altered in accordance with the remaining ink levels. That is, as shown in FIG. 10 and FIG. 11, the quantities of ink to be sucked by suction-processing are set to the consumption operating means 32 in advance (FIG. 10 (S166), FIG. 11 (S171)), and then it is judged whether or not the suction save mode is specified (FIG. 10 (S167), FIG. 11 (S172)). If the suction save mode is not specified, a first large-scale sucking operation (FIG. 10 (S168)) or a first small-scale sucking operation (FIG. 11 (S173)) is performed through a normal sucking operation, the first sucking operations sucking the specified quantity of ink.

On the other hand, if the suction save mode is specified while the remaining ink level is judged to be at the suction save level by the ink consumption check processing (FIG. 9) due to the ink in the ink cartridges 9, 10 having been reduced (FIG. 10 (S167), FIG. 11 (S172)), the suction save mode is released (FIG. 10 (S169), FIG. 11 (S174)), and a second large-scale sucking operation (FIG. 10 (S170)) or a second small-scale sucking operation (FIG. 11 (S175)) for sucking the added quantity of ink may be performed by suppressing the flow of ink during sucking while reducing the numbers of revolutions of the pumps 16, 17, driving the pumps 17, 18 intermittently, or the like.

Thus, the flow of ink to be sucked is suppressed without changing the quantity of ink needed for large-scale suction or small-scale suction. By doing so, in a particular case where an ink cartridge is of such type that an ink absorbing body made of a porous elastic body or the like is impregnated with ink, the quantity of ink needed for cleaning processing can be discharged while preventing interruption of the smooth flow of ink within the ink absorbing body. If the ink is running low, the quantity of ink needed for printing can be fed to the recording heads 7, 8 without interrupting smooth flow of ink within the ink absorbing body by reducing the printing speed. Therefore, the cartridges 9, 10 whose ink is running low can be consumed without being wasted.

While an example of a recording apparatus capable of effecting monochromatic and color printing by mounting two types of ink cartridges, one for black ink and the other for color inks, has been described in the aforementioned embodiment, it is apparent that similar advantages can be provided when the invention is applied to-recording apparatuses dedicated to only monochromatic printing.

Further, while an example of a recording apparatus that mounts ink cartridges on the carriage has been described in the aforementioned embodiment, it is apparent that similar advantages can be provided when the invention is applied to recording apparatuses in which an ink cartridge is accommodated in a casing and the ink is supplied to the recording head through a passage forming means such as a tube.

TABLE 1

QUANTITY BY WEIGHT OF INK PER INK DROPLET FOR PRINTING

| | WEIGHT (ng) | | |
|---|---|---|---|
| MODE | COLOR | BLACK 1 | BLACK 2 |
| HIGH-DEFINITION PRINT MODE | 25 | 60 | 20 |

TABLE 1-continued

| QUANTITY BY WEIGHT OF INK PER INK DROPLET FOR PRINTING | | | |
|---|---|---|---|
| | WEIGHT (ng) | | |
| MODE | COLOR | BLACK 1 | BLACK 2 |
| NORMAL PRINT MODE | 50 | 130 | 50 |
| DRAFT PRINT MODE | 60 | 120 | 55 |

TABLE 2

| QUANTITY BY WEIGHT OF INK PER INK DROPLET FOR FLUSHING | | | |
|---|---|---|---|
| | WEIGHT (ng) | | |
| MODE | COLOR | BLACK 1 | BLACK 2 |
| PRE-PRINTING FLUSHING | 55 | 140 | 54 |
| PERIODIC FLUSHING | | | |
| HIGH-DEFINITION PRINT MODE | 25 | 60 | 20 |
| NORMAL PRINT MODE | 50 | 130 | 50 |
| DRAFT PRINT MODE | 60 | 120 | 55 |
| PRE-ENDING FLUSHING | 60 | 150 | 58 |

TABLE 3

| JUDGMENT LEVEL | |
|---|---|
| JUDGMENT LEVEL | REMAINING INK LEVEL (%) |
| INK END | 0 |
| INK END BEFORE CLEANING | 1~5 |
| NEAR END | 2~20 |
| LARGE-SCALE SUCTION PROHIBIT | 2~25 |
| SUCTION PROHIBIT | 2~30 |

There is claimed:

1. An ink jet recording apparatus comprising:

an ink jet recording head for jetting an ink droplet in accordance with printing data;

an ink cartridge supplying ink to said recording head;

capping means for sealing said recording head;

a suction pump for evacuating said capping means to a negative pressure;

suction control means for controlling suction processing for discharging said ink by sucking said recording head with said suction pump; and remaining ink level judging means for controlling a quantity of ink in said ink cartridge by integrating quantities of ink discharged from said recording head;

wherein said remaining ink level judging means adds a quantity of ink to be discharged by said suction processing as a quantity of ink consumed, said addition being made before said suction processing is performed.

2. An ink jet recording apparatus according to claim 1, wherein:

said suction processing is intermittently performed a plurality of times; and a quantity of ink to be discharged by said sucking operation in said plurality of times is added as a quantity of ink consumed before starting to perform said sucking operation said plurality of times.

3. An ink jet recording apparatus according to claim 1, further comprising:

flushing means for jetting an ink droplet to prevent said recording head from clogging, wherein a quantity of ink to be discharged by flushing processing being added as a quantity of ink consumed before said flushing processing is performed.

4. An ink jet recording apparatus according to claim 3, further comprising means for setting a quantity of ink to be jetted per ink droplet during said flushing processing.

5. An ink jet recording apparatus according to claim 1, further comprising means for reducing a printing speed when a remaining ink level judged by said remaining ink level judging means is equal to or smaller than a predetermined value.

6. An ink jet recording apparatus comprising:

an ink jet recording head for jetting an ink droplet in accordance with printing data;

an ink cartridge supplying ink to said recording head;

capping means for sealing said recording head;

a suction pump for subjecting said capping means to a negative pressure;

suction control means for controlling suction processing for discharging said ink by sucking said recording head with said suction pump; and remaining ink level judging means for judging a remaining ink level of said ink cartridge, wherein said remaining ink level judging means adds a quantity of ink to be discharged by said suction processing as a quantity of ink consumed before said suction processing is performed;

and wherein when said remaining ink level is equal to or smaller than a predetermined value, said suction control means limits a quantity of ink to be sucked.

7. An ink jet recording apparatus according to claim 6, further comprising:

flushing means for jetting an ink droplet to prevent said recording head from clogging, wherein a quantity of ink to be discharged by flushing processing being added as a quantity of ink consumed before said flushing processing is performed.

8. An ink jet recording apparatus according to claim 7, further comprising means for setting a quantity of ink to be jetted per ink droplet during said flushing processing.

9. An ink jet recording apparatus according to claim 6, further comprising means for setting a print duty based on said remaining ink level judged by said remaining ink level judging means.

10. An ink jet recording apparatus according to claim 6, further comprising means for reducing a printing speed when a remaining ink level judged by said remaining ink level judging means is equal to or smaller than a predetermined value.

11. An ink jet recording apparatus comprising:

an ink jet recording head for jetting an ink droplet in accordance with printing data;

an ink cartridge supplying ink to said recording head;

capping means for sealing said recording head;

a suction pump for evacuating said capping means to a negative pressure;

suction control means for controlling suction processing for discharging said ink by sucking said recording head with said suction pump;

remaining ink level judging means for judging a remaining ink level of said ink cartridge; and means for setting a print duty based on said remaining ink level judged by said remaining ink level judging means;

wherein when said remaining ink level is equal to or smaller than a predetermined value, said suction control means limits an ink sucking speed.

12. An ink jet recording apparatus comprising:

an ink jet recording head for jetting an ink droplet in accordance with printing data;

an ink cartridge supplying ink to said recording head; and remaining ink level judging means for adding a quantity of ink to be jetted out of said recording head, based on said printing data, every predetermined printing operation of said recording head.

13. An ink jet recording apparatus according to claim 12, wherein said remaining ink level judging means adjusts a quantity of ink to be jetted per ink droplet during printing so as to correspond to a printing mode.

14. An ink jet recording apparatus according to claim 12, wherein:

said remaining ink level judging means adds a quantity of ink to be consumed per pass in advance of starting a printing operation; and subtracts said added quantity of ink after having terminated printing of a single pass.

15. An ink jet recording apparatus according to claim 12, further comprising:

flushing means for jetting an ink droplet to prevent said recording head from clogging; and a quantity of ink to be discharged by flushing processing being added as a quantity of ink consumed before said flushing processing is performed.

16. An ink jet recording apparatus according to claim 15, further comprising means for setting a quantity of ink to be jetted per ink droplet during said flushing processing.

17. An ink jet recording apparatus according to claim 12, further comprising means for setting a print duty based on said remaining ink level judged by said remaining ink level judging means.

18. An ink jet recording apparatus according to claim 12, wherein said quantity of ink to be jetted per ink droplet is changed in accordance with the ink temperature.

19. An ink jet recording apparatus according to claim 12, further comprising means for reducing a printing speed when a remaining ink level judged by said remaining ink level judging means is equal to or smaller than a predetermined value.

20. An ink jet recording apparatus comprising:

an ink jet recording head for jetting an ink droplet in accordance with printing data;

an ink cartridge supplying ink to said recording head;

capping means for sealing said recording head;

a suction pump for subjecting said capping means to a negative pressure;

suction control means for controlling suction processing for discharging said ink by sucking said recording head with said suction pump;

remaining ink level judging means for controlling a quantity of ink in said ink cartridge by integrating quantities of ink discharged from said recording head; and means for relatively displaying said remaining ink level as being full, after performing said suction processing when a new ink cartridge has been loaded to said recording head;

wherein said remaining ink level judging means adds a quantity of ink to be discharged by said suction processing, as a quantity of ink consumed, before said sucking operation is performed.

21. An ink jet recording apparatus according to claim 20, wherein said remaining ink level is displayed on a host computer.

22. An ink jet recording apparatus comprising:

an ink jet recording head for jetting an ink droplet in accordance with printing data;

an ink cartridge supplying ink to said recording head;

remaining ink level judging means for adding a quantity of ink to be jetted out of said recording head, based on said printing data, every time said recording head performs a predetermined printing operation; and load time detecting means for detecting an integrated time for which said ink cartridge has been loaded to said recording head;

wherein said remaining ink level judging means judges and displays said remaining ink level taking into account a quantity of ink evaporated from said ink cartridge based on said integrated time.

23. An ink jet recording apparatus according to claim 22, wherein said remaining ink level is displayed on a host computer.

24. An ink jet recording apparatus comprising:

an ink jet recording head for jetting an ink droplet in accordance with printing data;

an ink cartridge supplying ink to said recording head;

capping means for sealing said recording head;

a suction pump for evacuating said capping means to a negative pressure;

suction control means for controlling suction processing for discharging said ink by sucking said recording head with said suction pump; and remaining ink level judging means for controlling a quantity of ink in said ink cartridge by integrating quantities of ink discharged from said recording head;

wherein said remaining ink level judging means has at least two judgement levels, including an ink end judgement level used during printing and an ink end judgment level used before performing said sucking operation.

25. An ink jet recording apparatus according to claim 24, wherein said remaining ink level judging means further includes a third judgment level substantially the same as said ink end judgment level immediately before performing said suction processing, said third judgment level defining an ink near end judgment level used during printing.

26. An ink jet recording apparatus comprising:

an ink jet recording head for jetting an ink droplet in accordance with printing data;

an ink cartridge supplying ink to said recording head;

remaining ink level judgment means for adding a quantity of ink to be jetted out of said recording head based on printing data every time said recording head performs a predetermined printing operation; and ink cartridge replacement detecting means for detecting replacement of said ink cartridge;

wherein when a remaining ink level is lower than a second ink end level that is slightly higher than an ink end judgment level, said remaining ink level judging means is reset by a signal from said ink cartridge replacement detecting means.

27. An ink jet recording apparatus comprising:

an ink jet recording head for jetting an ink droplet in accordance with printing data;

an ink cartridge supplying ink to said recording head;

capping means for sealing said recording head;

a suction pump for evacuating said capping means to a negative pressure;

suction control means for controlling suction processing for discharging said ink by sucking said recording head with said suction pump;

remaining ink level judging means for managing a quantity of ink in said ink cartridge by integrating quantities of ink discharged from said recording head and adding a quantity of ink to be jetted out of said recording head based on said printing data every time said recording head performs a predetermined printing operation; and ink cartridge replacement detecting means for detecting replacement of said ink cartridge;

wherein said remaining ink level judging means has at least three judgment levels, including a first ink end judgment level used during printing; a second ink end judgment level used before performing said sucking operation; and a third ink end judgment level slightly higher than said first ink end judgment level, and wherein when said remaining ink level is below said third ink end judgment level, said remaining ink level judgment means is reset by a signal from said ink cartridge replacement detecting means.

28. An ink jet recording apparatus comprising:

an ink jet recording head for jetting an ink droplet in accordance with printing data;

an ink cartridge supplying ink to said recording head;

capping unit which seals said recording head;

a suction pump for subjecting said capping unit to a negative pressure;

suction controller which controls suction processing for discharging said ink by sucking said recording head with said suction pump; and remaining ink level judging controller which controls a quantity of ink in said ink cartridge by integrating quantities of ink discharged from said recording head;

wherein said remaining ink level judging controller adds a quantity of ink to be discharged by said suction processing as a quantity of ink consumed, said addition being made before said suction processing is performed.

29. An ink jet recording apparatus comprising:

an ink jet recording head for jetting an ink droplet in accordance with printing data;

an ink cartridge supplying ink to said recording head;

capping unit which seals said recording head;

a suction pump for subjecting said capping unit to a negative pressure;

suction controller which controls suction processing for discharging said ink by sucking said recording head with said suction pump; and remaining ink level detector which judges a remaining ink level of said ink cartridge, wherein said remaining ink level detector adds a quantity of ink to be discharged by said suction processing as a quantity of ink consumed before said suction processing is performed;

and wherein when said remaining ink level is equal to or smaller than a predetermined value, said suction controller limits a quantity of ink to be sucked.

30. An ink jet recording apparatus comprising:

an ink jet recording head for jetting an ink droplet in accordance with printing data;

an ink cartridge supplying ink to said recording head;

capping unit which seals said recording head;

a suction pump for subjecting said capping unit to a negative pressure;

suction controller which controls suction processing for discharging said ink by sucking said recording head with said suction pump;

remaining ink level detector which judges a remaining ink level of said ink cartridge; and controller which sets a print duty based on said remaining ink level judged by said remaining ink level detector;

wherein when said remaining ink level is equal to or smaller than a predetermined value, said suction controller limits an ink sucking herein.

31. An ink jet recording apparatus comprising:

an ink jet recording head for jetting an ink droplet in accordance with printing data;

an ink cartridge supplying ink to said recording head; and remaining ink level judging controller which adds a quantity of ink to be jetted out of said recording head, based on said printing data, every predetermined printing operation of said recording head.

32. An ink jet recording apparatus comprising:

an ink jet recording head for jetting an ink droplet in accordance with printing data;

an ink cartridge supplying ink to said recording head;

capping unit which seals said recording head;

a suction pump for subjecting said capping unit to a negative pressure;

suction controller which controls suction processing for discharging said ink by sucking said recording head with said suction pump;

remaining ink level judging controller which controls a quantity of ink in said ink cartridge by integrating quantities of ink discharged from said recording head; and display which relatively displays said remaining ink level as being full, after performing said suction processing when a new ink cartridge has been loaded to said recording head;

wherein said remaining ink level judging controller adds a quantity of ink to be discharged by said suction processing, as a quantity of ink consumed, before said sucking operation is performed.

33. An ink jet recording apparatus comprising:

an ink jet recording head for jetting an ink droplet in accordance with printing data;

an ink cartridge supplying ink to said recording head;

remaining ink level judging controller which adds a quantity of ink to be jetted out of said recording head, based on said printing data, every time said recording head performs a predetermined printing operation; and load time detector which detects an integrated time for which said ink cartridge has been loaded to said recording head;

wherein said remaining ink level judging controller judges and displays said remaining ink level taking into account a quantity of ink evaporated from said ink cartridge based on said integrated time.

34. An ink jet recording apparatus comprising:

an ink jet recording head for jetting an ink droplet in accordance with printing data;

an ink cartridge supplying ink to said recording head;

capping unit which seals said recording head;

a suction pump for subjecting said capping unit to a negative pressure;

suction controller which controls suction processing for discharging said ink by sucking said recording head with said suction pump; and remaining ink level judging controller which controls a quantity of ink in said ink cartridge by integrating quantities of ink discharged from said recording head;

wherein said remaining ink level judging controller has at least two judgment levels, including an ink end judgment level used during printing and an ink end judgment level used before performing said sucking operation.

35. An ink jet recording apparatus comprising:

an ink jet recording head for jetting an ink droplet in accordance with printing data;

an ink cartridge supplying ink to said recording head;

remaining ink level judging controller which adds a quantity of ink to be jetted out of said recording head based on said printing data, every time said recording head performs a predetermined printing operation; and ink cartridge replacement detector which detects replacement of said ink cartridge;

wherein when said remaining ink level is lower than a second ink end level that is slightly higher than an ink end judgment level, said remaining ink level judging controller is reset by a signal from said ink cartridge replacement detector.

36. An ink jet recording apparatus comprising:

an ink jet recording head for jetting an ink droplet in accordance with printing data;

an ink cartridge supplying ink to said recording head;

capping unit which seals said recording head;

a suction pump for subjecting said capping unit to a negative pressure;

suction controller which controls suction processing for discharging said ink by sucking said recording head with said suction pump;

remaining ink level judging controller which manages a quantity of ink in said link cartridge by integrating quantities of ink discharged from said recording head and adding a quantity of ink to be jetted out of said recording head based on said printing data every time said recording head performs a predetermined printing operation; and ink cartridge replacement detector which detects replacement of said ink cartridge;

wherein said remaining ink level judging controller has at least three judgment levels, including a first ink end judgment level used during printing; a second ink end judgment level used before performing said sucking operation; and a third ink end judgment level slightly higher than said first ink end judgment level, and wherein when said remaining ink level is below said third ink end judgment level, said remaining ink level judging controller is reset by a signal from said ink cartridge replacement detector.

* * * * *